US012372291B2

(12) United States Patent
Park et al.

(10) Patent No.: US 12,372,291 B2
(45) Date of Patent: Jul. 29, 2025

(54) REFRIGERATOR

(71) Applicant: LG Electronics Inc., Seoul (KR)

(72) Inventors: Hyun Woo Park, Seoul (KR); Hyoung Keun Lim, Seoul (KR); Jae Duck Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 202 days.

(21) Appl. No.: 17/870,410

(22) Filed: Jul. 21, 2022

(65) Prior Publication Data

US 2023/0221055 A1 Jul. 13, 2023

(30) Foreign Application Priority Data

Jan. 13, 2022 (KR) ..... 10-2022-0005420

(51) Int. Cl.
*F25D 11/02* (2006.01)

(52) U.S. Cl.
CPC ..... *F25D 11/025* (2013.01)

(58) Field of Classification Search
CPC .... F25D 11/025; F25D 29/005; F25D 23/006; A47B 73/008
See application file for complete search history.

(56) References Cited

U.S. PATENT DOCUMENTS 4,688,491 A * 8/1987 Herrera ..... A47B 21/06 174/152 G
6,412,286 B1 7/2002 Park et al.
10,712,083 B1 * 7/2020 Choi ..... F25D 23/021
2005/0039997 A1 * 2/2005 Mackin ..... H02G 11/02 191/12.2 R
2012/0304667 A1 * 12/2012 Shin ..... F25B 21/02 62/3.6
2015/0330678 A1 11/2015 Hu
2018/0180349 A1 * 6/2018 Han ..... F25D 11/00
2020/0011584 A1 * 1/2020 Kim ..... F25D 23/02
(Continued)

FOREIGN PATENT DOCUMENTS

CH 703730 2/2012
CH 703730 A2 * 2/2012 ..... F25B 21/04
(Continued)

OTHER PUBLICATIONS

Extended European Search Report in European Appln. No. 22185164.5, dated Dec. 8, 2022, 7 pages.
(Continued)

*Primary Examiner* — Matthew W Ing
(74) *Attorney, Agent, or Firm* — Fish & Richardson P.C.

(57) ABSTRACT

A refrigerator includes a main body defining a first cooling space, a door configured to open and close the first cooling space of the main body, a first heat pump module disposed in the main body and configured to cool the first cooling space, an independent refrigerator that is detachably disposed in the first cooling space and defines a second cooling space separate from the first cooling space, a second heat pump module disposed in the independent refrigerator and configured to cool the second cooling space of the independent refrigerator, a main body power supply part that is disposed in the main body and configured to supply power, and an independent power supply part disposed in the independent refrigerator.

13 Claims, 11 Drawing Sheets

(56) References Cited

U.S. PATENT DOCUMENTS

| | | | | |
|---|---|---|---|---|
| 2020/0121080 | A1* | 4/2020 | Wantland | A47B 96/025 |
| 2020/0408452 | A1* | 12/2020 | Alexander | F25D 11/006 |

FOREIGN PATENT DOCUMENTS

| | | | |
|---|---|---|---|
| CN | 108151395 | | 6/2018 |
| EP | 3385641 | | 10/2018 |
| EP | 3663686 | | 6/2020 |
| EP | 3933314 | | 1/2022 |
| JP | 2001-201234 | | 7/2001 |
| KR | 20020045033 | A * | 6/2002 |
| KR | 20030012074 | | 2/2003 |
| KR | 100628096 | | 9/2006 |
| KR | 101146216 | | 5/2012 |
| KR | 20190014051 | | 2/2019 |
| KR | 102216619 | | 2/2021 |
| WO | WO 2019/165522 | | 9/2019 |

OTHER PUBLICATIONS

International Search Report in International Appln. No. PCT/KR2022/011942, dated Nov. 10, 2022, 4 pages.

* cited by examiner (a)

(b)

REFRIGERATOR

CROSS-REFERENCE TO RELATED APPLICATIONS

This application claims priority under 35 U.S.C. 119 and 35 U.S.C. 365 to Korean Patent Application No. 10-2022-0005420, filed on Jan. 13, 2022, in the Korean Intellectual Property Office, the disclosure of which is hereby incorporated by reference in its entirety.

TECHNICAL FIELD

This disclosure relates to a refrigerator that independently controls the temperature of a predetermined area inside the refrigerator.

BACKGROUND

Refrigerators are home appliances for storing foods at a low temperature in an internal storage space that can be divided into a refrigerator space and a freezer space according to the temperature of the food stored inside the refrigerator. In some examples, the temperature in a refrigerator space can be maintained at 3 to 4° C., and the temperature in a freezer space can be maintained at about −20° C.

However, the appropriate temperature range may vary depending on the type of food to be stored in the refrigerator. For example, the appropriate temperature range for storage of alcoholic beverages, such as wine, is 4 to 18° C., for storage of kimchi, fruits and vegetables is 0 to 5° C., and for storage of meat and fish, the appropriate temperature range may be varied, such as below −5° C.

In some cases, refrigerators can include various structures and functions to accommodate different lifestyles and uses of users. For example, refrigerators can include kimchi refrigerators, wine refrigerators, rice refrigerators, cosmetics refrigerators, and even tabletop refrigerators.

In some cases, a refrigerator having such various temperatures and uses can be implemented by defining predetermined spaces inside the refrigerator.

For example, in the form of Korean Patent Registration No. 10-1146216, a method of implementing independent cooling by providing a plurality of evaporators under a single cooling cycle system and arranging the plurality of evaporators in a plurality of spaces is proposed. However, in the system, there is a risk of various problems such as controlling the circulation direction of the refrigerant and the generation of noise as the cooling cycle becomes complicated, and there is a disadvantage in that the cost of a device increases excessively.

In some cases, separate spaces can be fixed in a refrigerator. However, if a separate space is separately controlled and used as a separate refrigerator, its effectiveness can be further increased.

In some examples, a separately controlled refrigerator can cause inconvenience by occupying space when not being utilized.

SUMMARY

The present application describes a refrigerator that independently controls the temperature of a predetermined area inside the refrigerator.

The present application further describes a refrigerator in which a separated area may operate independently.

The present application further describes a refrigerator that has a separated area that receives power from a main body when the separated area is coupled to the main body.

According to one aspect of the subject matter described in this application, a refrigerator can include: a main body defining a first cooling space; a door configured to open and close the first cooling space of the main body; a first heat pump module disposed in the main body and configured to cool the first cooling space; an independent refrigerator that is detachably disposed in the first cooling space and defines a second cooling space separate from the first cooling space; a second heat pump module disposed in the independent refrigerator and configured to cool the second cooling space of the independent refrigerator; a main body power supply part that is disposed in the main body and configured to supply power; and an independent power supply part disposed in the independent refrigerator.

Implementations according to this aspect can include one or more of the following features. For example, the independent refrigerator can include: an outer housing defining an external shape of the independent refrigerator, an inner housing defining the second cooling space of the independent refrigerator, and a storage compartment configured to be inserted into or withdrawn from the inner housing, wherein the second heat pump module is disposed in a space defined between the outer housing and the inner housing.

In some implementations, the first heat pump module can include a compressor, a condenser, an expansion valve, and an evaporator.

In some implementations, the second heat pump module can include a thermoelectric element.

In some implementations, the independent power supply part can include a battery.

In some implementations, the independent power supply part can be electrically connected to the main body power supply part to receive power.

In some implementations, the independent power supply part can be electrically connected to the main body power supply part through a power cable disposed at a side of the first cooling space of the main body.

In some implementations, the power cable can be disposed in a cable box that is disposed in the main body but not to invade the first cooling space, and wherein the cable box is configured to, based on a surface of the cable box being opened toward the first cooling space, be in fluid communication with the first cooling space.

In some implementations, the cable box can include: a first area configured to receive a power cable terminal and, based on the cable box being opened, be in fluid communication with the first cooling space, and a second area configured to receive the power cable and be closed toward the first cooling space.

In some implementations, the power cable can be an automatic reel type that is disposed in the second area, and configured to, based on a withdrawal of the power cable terminal, be drawn out and change a length exposed to the first cooling space.

In some implementations, the power cable can be electrically connected to the main body power supply part, and the power cable terminal can be coupled to the independent power supply part of the independent refrigerator to electrically connect the main body power supply part and the independent power supply part.

In some implementations, the cable box can further include a cable box door configured to move between the first area and the second area and close or open the first area toward the first cooling space.

In some implementations, the independent refrigerator can further include a sliding door that is disposed at a surface of the storage compartment and configured to open and close the second cooling space, and wherein the sliding door comprises a control panel configured to control the independent refrigerator and display information of the independent refrigerator.

In some implementations, the control panel can be configured to receive power through an articulated cable, wherein the articulated cable has one side coupled to the control panel and the other side coupled to the independent power supply part, and wherein the articulated cable is a multi-joint type and configured to, based on a withdrawal of the storage compartment, deform while maintaining a predetermined curvature within a preset direction and a preset angle range.

In some implementations, the first cooling space can include a refrigerator space and a freezer space.

In some implementations, the independent refrigerator can be disposed in the refrigerator space.

In some implementations, the independent refrigerator can be disposed in the freezer space.

In some implementations, the storage compartment can include a swing bar that is disposed in a width direction of the storage compartment and configured to rotate around a virtual axis parallel to the width direction of the storage compartment.

In some implementations, the swing bar can include a beverage holder defining a plurality of semicircular grooves.

In some implementations, the swing bar can be disposed at a predetermined distance from the sliding door.

According to example embodiments, the independent refrigerator may operate independently in a temperature range different from the internal temperature of the refrigerator.

According to example embodiments, when the independent refrigerator is disposed inside the refrigerator, the independent refrigerator may be electrically connected to the main body of the refrigerator to share power.

According to example embodiments, the independent refrigerator may operate as an independent individual refrigerator even if the independent refrigerator is separated from the refrigerator.

According to example embodiments, inside of the independent refrigerator may be used for various purposes through the swing bar installed in the independent refrigerator.

BRIEF DESCRIPTION OF THE DRAWINGS

The above and other aspects, features, and advantages of certain embodiments will be more apparent from the following detailed description taken in conjunction with the accompanying drawings, in which.

DETAILED DESCRIPTION

Figure 1:
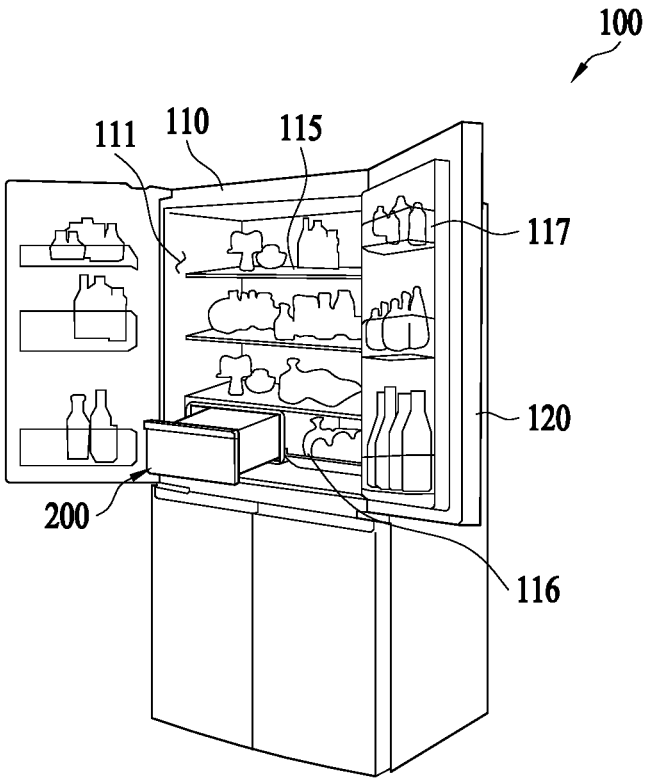
FIG. 1 is view illustrating an example state in which a door of a refrigerator is opened.

Hereinafter, exemplary implementations disclosed in the present disclosure will be described in detail with reference to the accompanying drawings, but identical or similar elements are denoted by the same reference numerals regardless of drawing numbers, and redundant descriptions thereof will be omitted. The suffixes "module" and "unit" for components used in the following description are given or used interchangeably in consideration of only the ease of preparation of the specification, and do not have meanings or roles that are distinguished from each other. In addition, in describing the implementations disclosed in the present disclosure, when it is determined that a detailed description of related known technologies may obscure the gist of the implementations disclosed in the present disclosure, the detailed description thereof will be omitted. In addition, the accompanying drawings are for easy understanding of the implementations disclosed in the present disclosure, but the technical idea disclosed in the present disclosure is not limited by the accompanying drawings, and it should be understood to include all modifications, equivalents, or substitutes included in the spirit and scope of the present disclosure.

Terms including an ordinal number such as first and second may be used to describe various elements, but the elements are not limited by the terms. These terms are used only for the purpose of distinguishing one component from another component.

When a component is referred to as being "coupled" or "connected" to another component, it should be understood that it may be directly coupled or connected to the other component, but other components may exist in the middle. On the other hand, when a component is referred to as being "directly coupled" or "directly connected" to another component, it should be understood that there is no other component in the middle.

Singular expressions include plural expressions unless the context clearly indicates otherwise.

In the present disclosure, terms such as "comprise" or "have" are intended to designate the presence of features, numbers, steps, actions, components, parts, or combinations thereof described in the specification, but it is to be understood that it does not preclude in advance the possibility of the presence or addition of one or more other features, numbers, steps, actions, components, parts, or combinations thereof.

Figure 2:
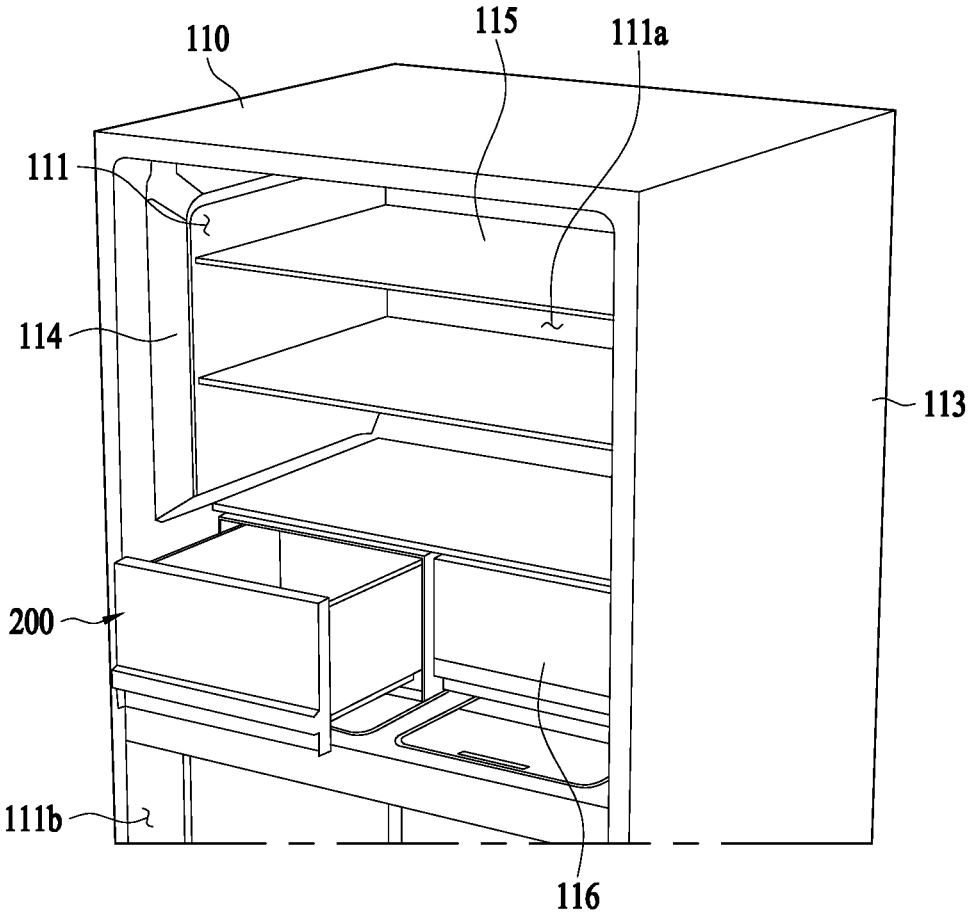
FIG. 2 is a view illustrating an example state of an internal structure of a first cooling space after a door of a refrigerator is removed.

FIG. 1 is view illustrating an example state in which a door 120 of a refrigerator 100 is opened, and FIG. 2 is a view illustrating an example state of an internal structure of a first cooling space 111 after the door 120 of the refrigerator 100 is removed.

In some implementations, the refrigerator 100 can include a main body 110 having a rectangular parallelepiped shape of the refrigerator 100, and the door 120 of the refrigerator 100 that can open and close the first cooling space 111 of the main body 110 at the front of the main body 110. In some implementations, the first cooling space 111 can include a refrigerator space 111*a* and a freezer space 111*b*. The refrigerator 100 can have a bottom freezer structure in which the refrigerator space 111*a* is provided at an upper portion and the freezer space 111*b* is provided at a lower portion. The refrigerator space 111*a* and the freezer space 111*b* can each include the door 120 that can be a double-door-type, which rotates and opens based on hinges of both ends. However, the present disclosure is not limited to the refrigerator 100 having the bottom freezer structure. In some implementations, the refrigerator 100 can have a structure wherein an independent refrigerator 200 is installed in the refrigerator space 111*a* or the freezer space 111*b*. In some implementations, the refrigerator 100 can have a side-by-side structure in which the refrigerator space 111*a* and the freezer space 111*b* are respectively disposed on the left and right. In some implementations, the refrigerator 100 can have a top mount structure in which the freezer space 111*b* is disposed above the refrigerator space 111*a*.

The main body 110 of the refrigerator 100 can include an outer case 113 defining the exterior and an inner case 114 that is provided to be spaced apart from the outer case 113 by a predetermined distance and defines the refrigerator space 111*a* and the freezer space 111*b*. In some examples, the space between the outer case 113 and the inner case 114 can be filled with a heat insulating material to thermally separate the refrigerator space 111*a* and the freezer space 111*b* from the external space of the refrigerator 100.

In some implementations, a shelf 115 and a drawer 116 can be disposed in the refrigerator space 111*a* and the freezer space 111*b* to increase space utilization efficiency, and the shelf 115 and the drawer 116 may be disposed to be guided along rails disposed on the left and right. A door basket 117 can be installed inside at the door 120 of the refrigerator space 111*a* and the door 120 of the freezer space 111*b*, so that the door basket 117 can be formed to be suitable for storing containers such as beverage bottles.

In some implementations, a machine room isolated from the freezer space 111*b* is disposed at a rear lower portion of the freezer space 111*b*, and a first heat pump module can be disposed in the machine room to operate the refrigerator 100. In some cases, the first heat pump module can refer to a refrigeration cooling cycle device using a refrigerant, and can include a compressor, a condenser, an expansion valve and an evaporator.

The first heat pump module can be powered by a main body power supply part connected to the main body 110. The main body power supply part can have power supplied through a power plug (for example, 100 to 220V power), and in addition to supplying power to the entire operation of the refrigerator 100, power may also be supplied to the independent refrigerator 200.

Figure 3:
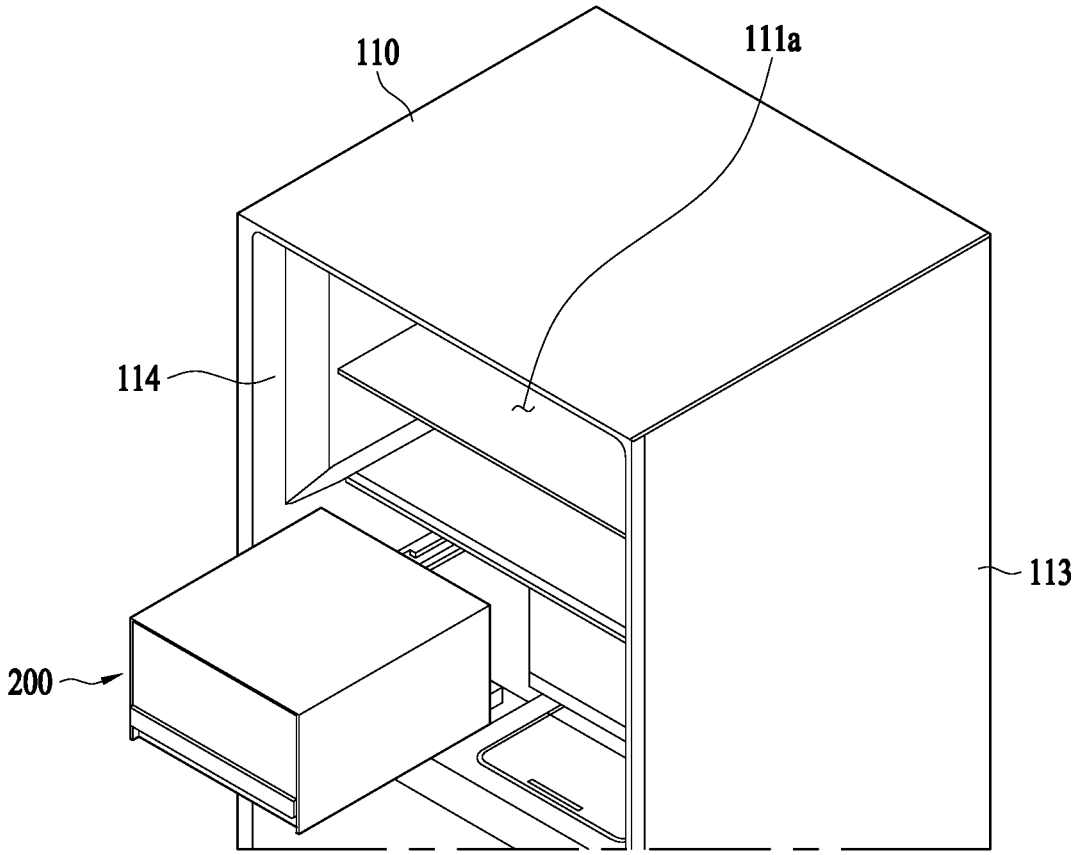
FIG. 3 is a view illustrating an example state of an independent refrigerator installed in a refrigerator.
Figure 4:
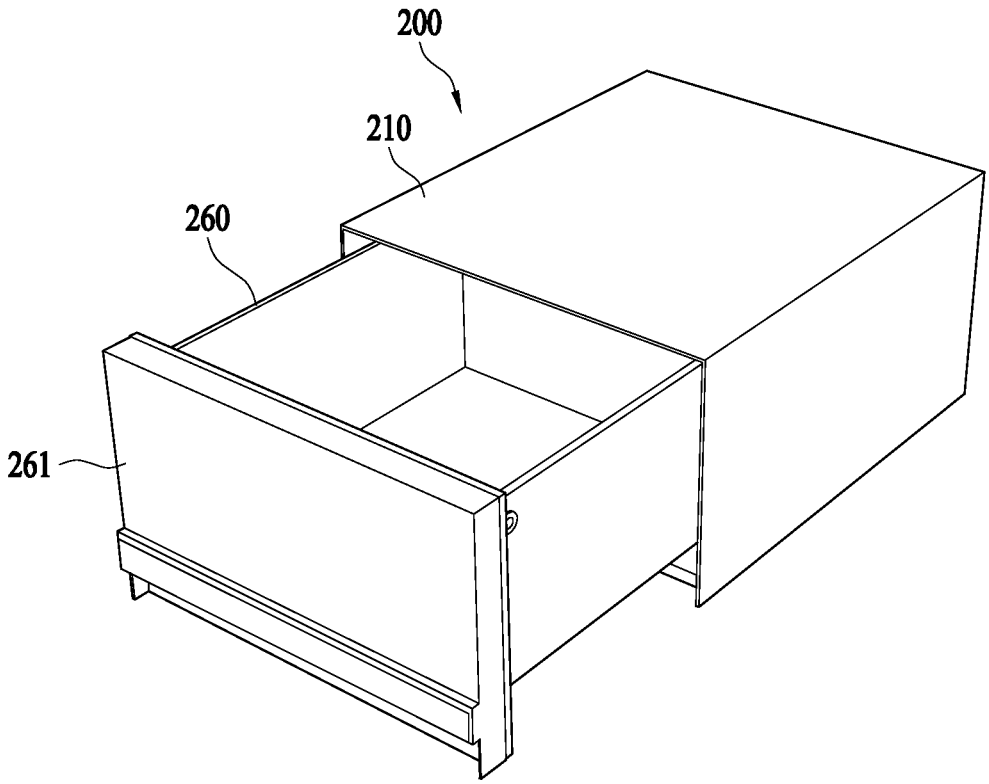
FIG. 4 is a view illustrating an example state in which an independent refrigerator is separated.

FIG. 3 is a view illustrating an example state in which the independent refrigerator 200 is installed in the refrigerator 100, and FIG. 4 is a view illustrating an example state in which the independent refrigerator 200 is separated.

In some implementations, the independent refrigerator 200 can be disposed in the freezer space 111*b* and used together as described above, but in order to facilitate understanding of the present disclosure, a case where the independent refrigerator 200 is disposed and used in the refrigerator space 111*a* will be mainly described.

In some cases, the independent refrigerator 200 can be installed in the refrigerator space 111*a* of the refrigerator 100 and used together, or can be separated and used as a separate independent small refrigerator. The independent refrigerator 200 can be defined as an insulated space independent of the refrigerator space 111*a*. In some implementations, the independent refrigerator 200 can include a second heat pump module 230 (see FIG. 5) and an independent power supply part 240 (see FIG. 5). For example, when the independent refrigerator 200 is mounted and used in the refrigerator space 111*a*, the independent refrigerator 200 can operate at a temperature in a range different from the temperature of the refrigerator space 111*a*, and when separated from the refrigerator 100, the independent refrigerator 200 can operate as a fully independent small refrigerator.

The independent power supply part 240 of the independent refrigerator 200 can be of a power supply method using a power plug, or the independent power supply part 240 can be a built-in battery. In some cases, the second heat pump module 230 can refer to a refrigeration cooling cycle device using a refrigerant, or can refer to a cooling device using a thermoelectric element. Further, in describing the refrigerator 100, for better understanding, a case where the independent power supply part 240 is a battery and the second heat pump module 230 is a thermoelectric element will be described as an example implementation.

In some implementations, the independent refrigerator 200 itself can be detachably attached to a portion of the refrigerator space 111*a* in a sliding form. However, it is not necessarily limited to a method of detaching by a sliding method, and a method for a user to conveniently separate the independent refrigerator 200 from and couple to the refrigerator 100 may be applied without limitation. When the independent refrigerator 200 is disposed in the refrigerator space 111*a*, power of the independent refrigerator 200 can be electrically connected to the main body power supply part to operate the independent refrigerator 200.

Figure 5:
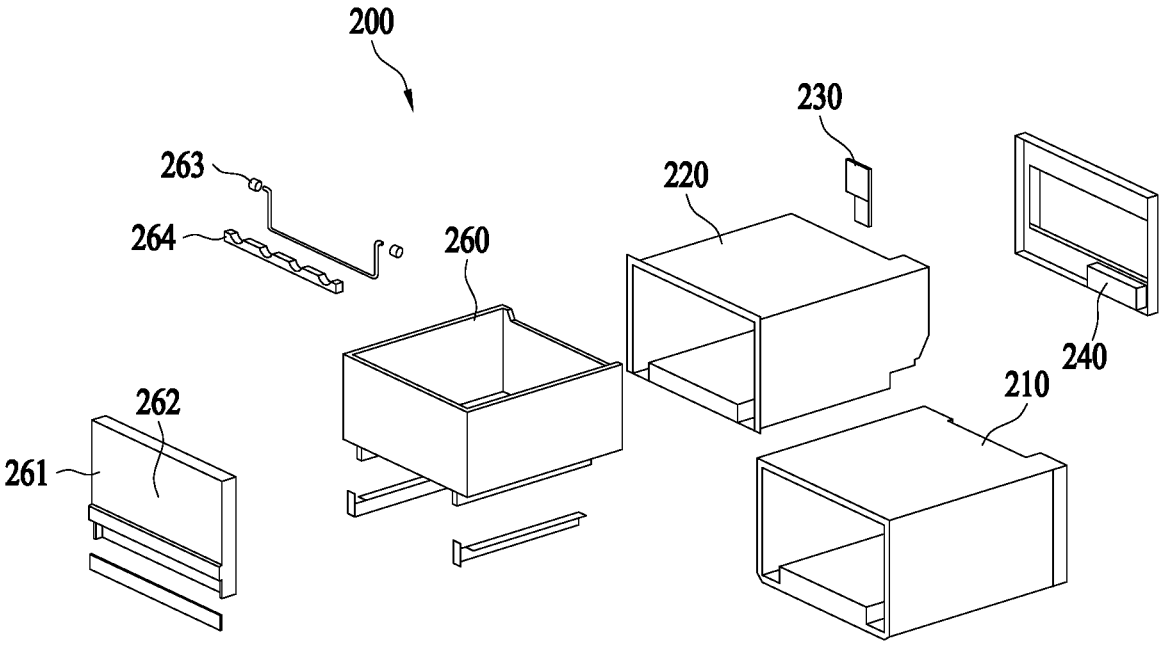
FIG. 5 is an exploded perspective view illustrating an example state of an independent refrigerator.

FIG. 5 is an exploded perspective view illustrating an example state of the independent refrigerator 200.

In some implementations, the independent refrigerator 200 can include an outer housing 210, an inner housing 220 and a storage compartment 260. The outer housing 210 and the inner housing 220 can be spaced apart from each other by a predetermined distance to define a space. The space defined by the outer housing 210 and the inner housing 220 being spaced apart can be filled with an insulating material to thermally separate a second cooling space of the inner housing 220 from the refrigerator space 111*a*.

The outer housing 210 can define an external shape when the independent refrigerator 200 is separated from the refrigerator 100. In the second cooling space of the inner housing 220, the storage compartment 260 can be configured to enter and exit the second cooling space of the inner housing 220. In some cases, the storage compartment 260 can be a sliding type that opens and closes.

The independent refrigerator 200 can further include a sliding door 261 and a control panel 262. The sliding door 261 can be disposed at one surface of the storage compartment 260 and close the second cooling space together with the inner housing 220. The control panel 262 can be disposed at the sliding door 261, and the independent refrigerator 200 can be controlled and the state of the independent refrigerator 200 may be identified through the control panel 262.

In some implementations, the control panel 262 can be a touch display panel. An operation mode of the independent refrigerator 200 can be set through the control panel 262. For example, the independent refrigerator 200 can be set to be in a beverage storage mode for mainly storing alcoholic beverages or other beverages, a vegetable storage mode for storing kimchi, fruits or vegetables, or a meat/fish storage mode for storing meat or fish. In some cases, the beverage storage mode can be set to operate the independent refrigerator 200 in the temperature range of about 4 to 8° C., the vegetable storage mode can be set to operate in the temperature range of about 0 to 5° C., and the meat/fish storage mode may be set to operate at about −5° C. The above temperature ranges are exemplary and the present disclosure is not limited to the numerical ranges, and the example implementations are meaningful that a user may easily set the temperature of the independent refrigerator 200 to operate within a preset temperature range by selecting an operation mode. In some examples, the independent refrigerator 200 can be set to operate at a fixed temperature that is a specific temperature arbitrarily set by a user through operation on the control panel 262, or the independent refrigerator 200 can be set to operate in an airtight storage mode so that odors inside the independent refrigerator 200 do not leak. For example, for the meat/fish storage mode, the airtight storage mode can be activated simultaneously to prevent leakage of odors. In some cases, the control panel 262 can display and control various information related to the independent refrigerator 200, such as a battery charge state and the remaining amount of the battery.

The second heat pump module 230 and the independent power supply part 240 can be disposed in a space between the outer housing 210 and the inner housing 220. In some implementations, the second heat pump module 230 can refer to a refrigeration cooling cycle device using a refrigerant, or can refer to a cooling device using a thermoelectric element. In some cases, in the refrigerator 100, a battery can be used as the independent power supply part 240, and a thermoelectric element can be used as the second heat pump module 230.

Figure 6:
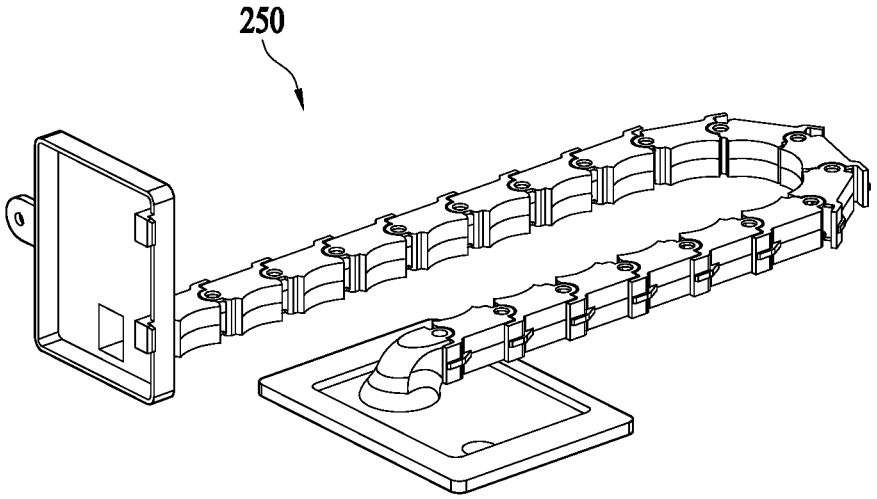
FIG. 6(*a*) is a view illustrating an example state of an articulated cable for supplying power to a control panel of an independent refrigerator, and (*b*) is a cross-sectional view illustrating an example state in which the articulated cable is installed in the independent refrigerator.
Figure 6:
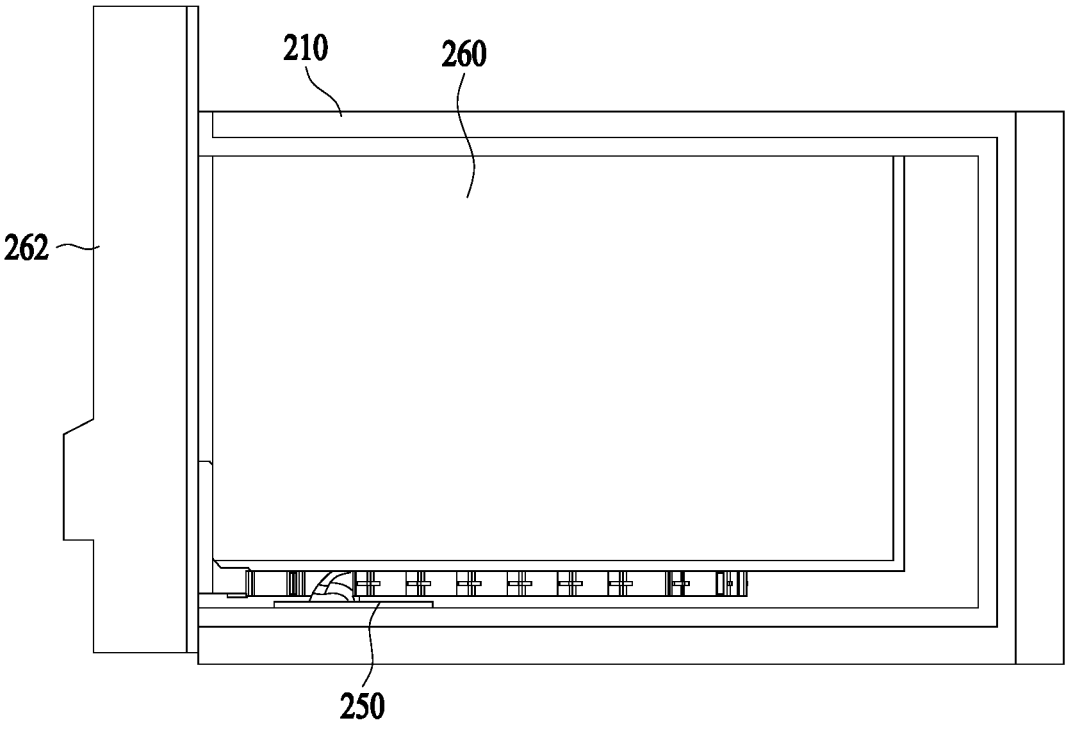

FIG. 6(*a*) is a view illustrating an example state of an articulated cable for supplying power to a control panel of an independent refrigerator, and FIG. 6(*b*) is a cross-sectional view illustrating an example state in which the articulated cable is installed in the independent refrigerator 200.

Since the independent refrigerator 200 can be controlled by the control panel 262 disposed at a surface of the storage compartment 260, and the control panel 262 is configured to display various information of the independent refrigerator 200, power supply may be required. However, since the distance between the control panel 262 receiving power and the power supply point can change as the storage compartment 260 moves in a sliding type, a fixed power supply line can be easily disconnected. Accordingly, the control panel 262 of the independent refrigerator 200 can receive power through an articulated cable 250.

In some cases, the articulated cable 250 can have one end coupled to the control panel 262 and the other end coupled to the independent power supply part 240. In some examples, the articulated cable 250 can have a multi-joint shape and can be deformed while maintaining a predetermined curvature within the preset direction and a preset angle range according to the entry and exit of the storage compartment 260. Since the articulated cable 250 is deformed while maintaining the predetermined curvature within the preset direction and the preset angle range, a power cable connected to the control panel 262 can be prevented from being deformed beyond the elastic limit, and disconnection can be prevented.

Figure 7:
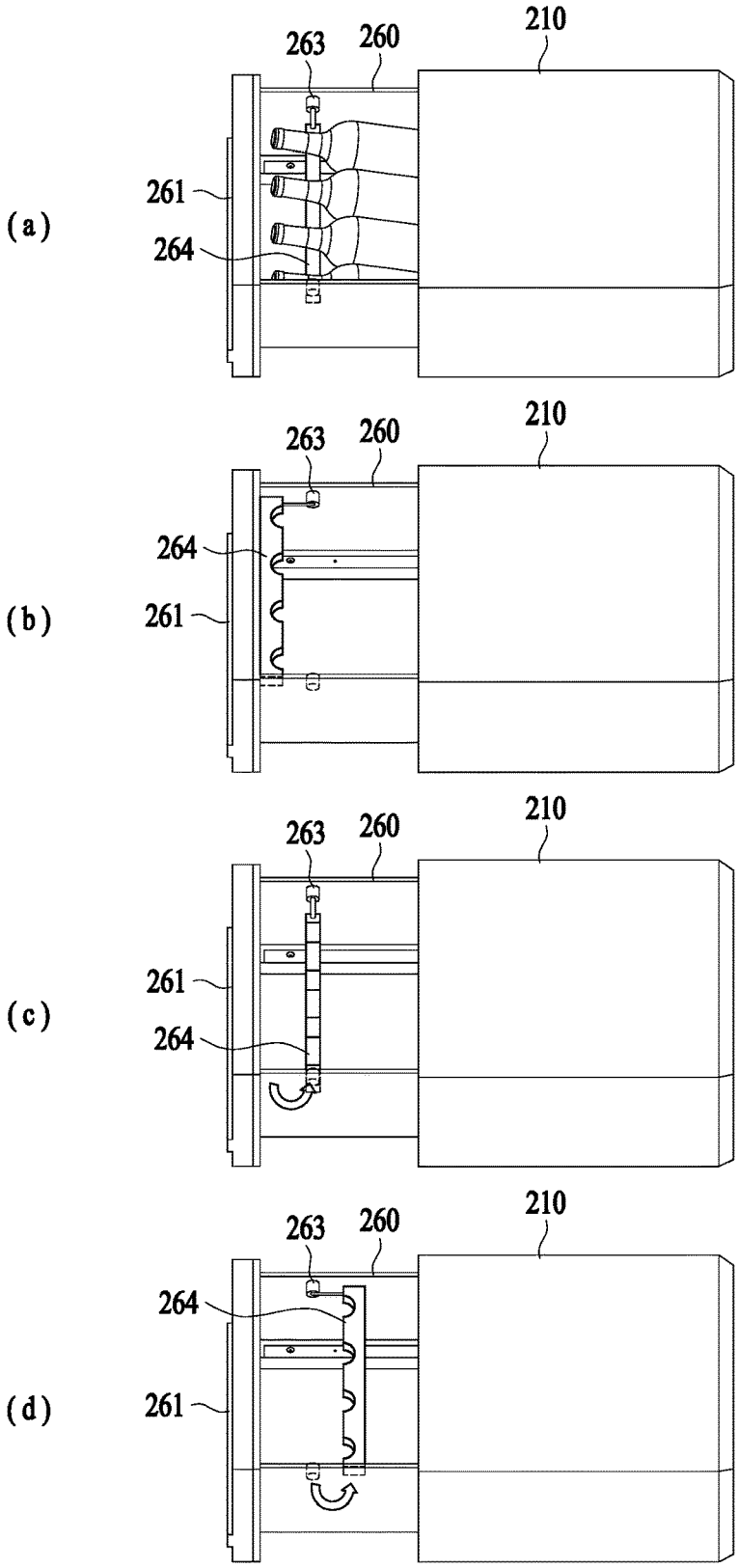
FIG. 7(*a*) to (*d*) are views illustrating various examples of utilization of an independent refrigerator.

FIG. 7(*a*) to (*d*) are views illustrating various examples of utilization of the independent refrigerator 200.

In some implementations, a swing bar 263 can be disposed inside the independent refrigerator 200. In some cases, the swing bar 263 can be disposed to cross the storage compartment 260 in the width direction, and can be rotatable with respect to an arbitrary axis formed in parallel with the width direction of the storage compartment 260. In some cases, the swing bar 263 can be disposed to be spaced from the sliding door 261 by a predetermined distance.

In some examples, the swing bar 263 can have a beverage holder 264 formed with semicircular grooves. As shown in FIG. 7(*b*), when the swing bar 263 rotates toward the sliding door 261, the swing bar 263 can be disposed to not interfere with the utilization of the entire space of the storage compartment 260. In some cases, when the swing bar 263 is disposed as shown in FIGS. 7(*c*) and (*d*), the swing bar 263 can be utilized for the purpose of dividing the space of the storage compartment 260.

Figure 8:
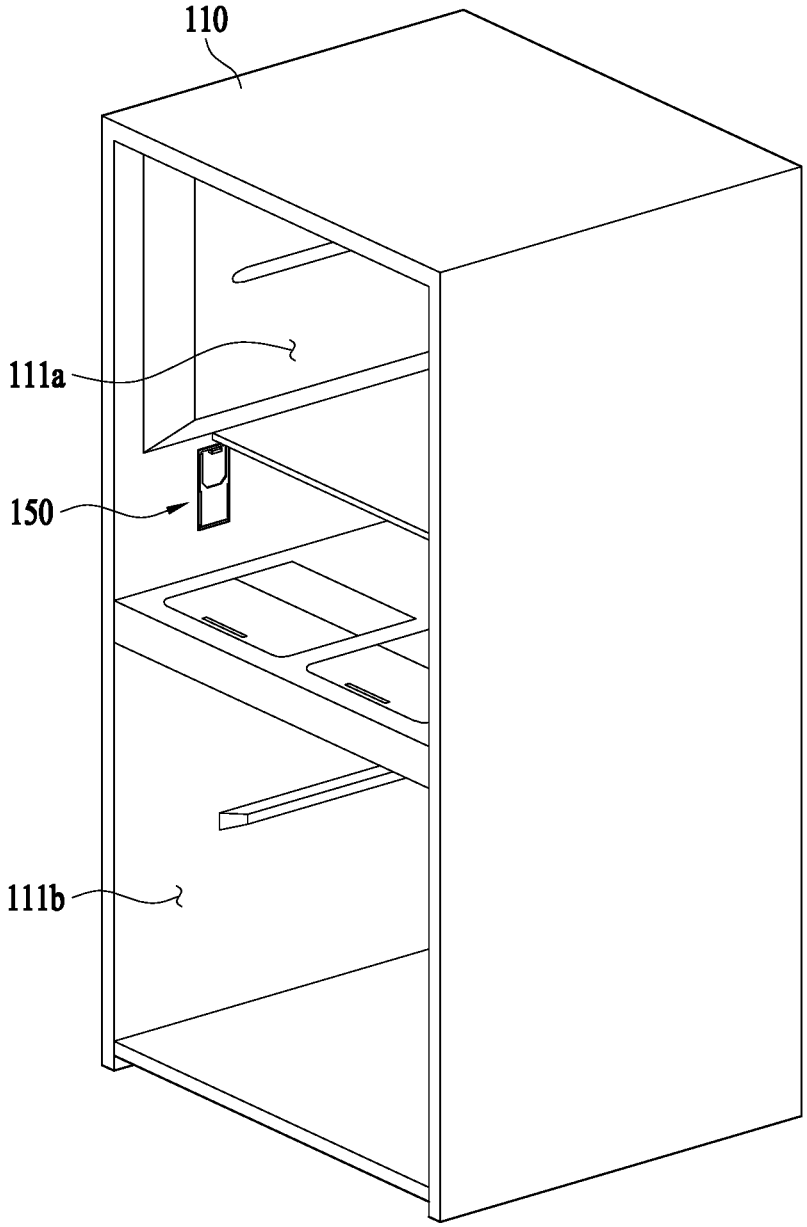
FIG. 8 is a view illustrating an example state of a location where a cable box is located in a refrigerator.
Figure 9:
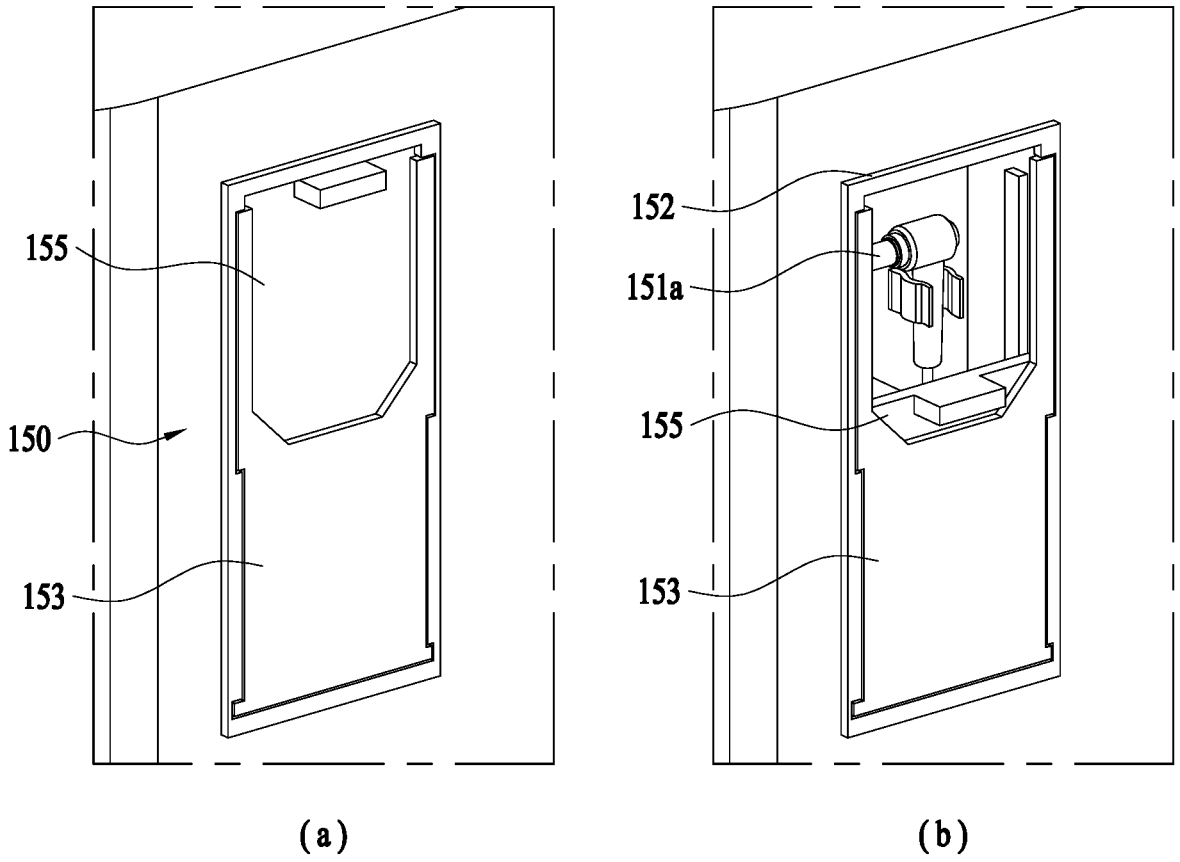
FIG. 9(*a*) is a view illustrating an example of a closed state of a cable box door of a cable box, and (*b*) is a view illustrating an example of an open state of the cable box door of the cable box.

FIG. 8 is a view illustrating an example state of a location where a cable box 150 can be located in the refrigerator 100. FIG. 9(*a*) is a view illustrating an example of a closed state of a cable box door of a cable box, and FIG. 9(*b*) is a view illustrating an example of an open state of the cable box door of the cable box.

In some implementations, the cable box 150 can be configured to communicate with the first cooling space 111 of the main body 110. In some cases, as the first cooling space 111 can include the refrigerator space 111*a* and the freezer space 111*b*, the cable box 150 can be disposed in the refrigerator space 111*a* or the freezer space 111*b*. Further, in order to facilitate understanding of the present disclosure, a case in which the cable box 150 is disposed in the refrigerator space 111*a* will be described as an example implementation, based on the case in which the independent refrigerator 200 is disposed in the refrigerator space 111*a*.

The cable box 150 can be disposed on the main body 110 but not to invade the first cooling space 111. In some examples, the cable box 150 can be disposed in the space between the outer case 113 and the inner case 114 of the main body 110 of the refrigerator. In some examples, the cable box 150 can be disposed so that one surface opens and closes toward the first cooling space 111, and thus the cable box 150 can communicate with the first cooling space 111.

Figure 10:
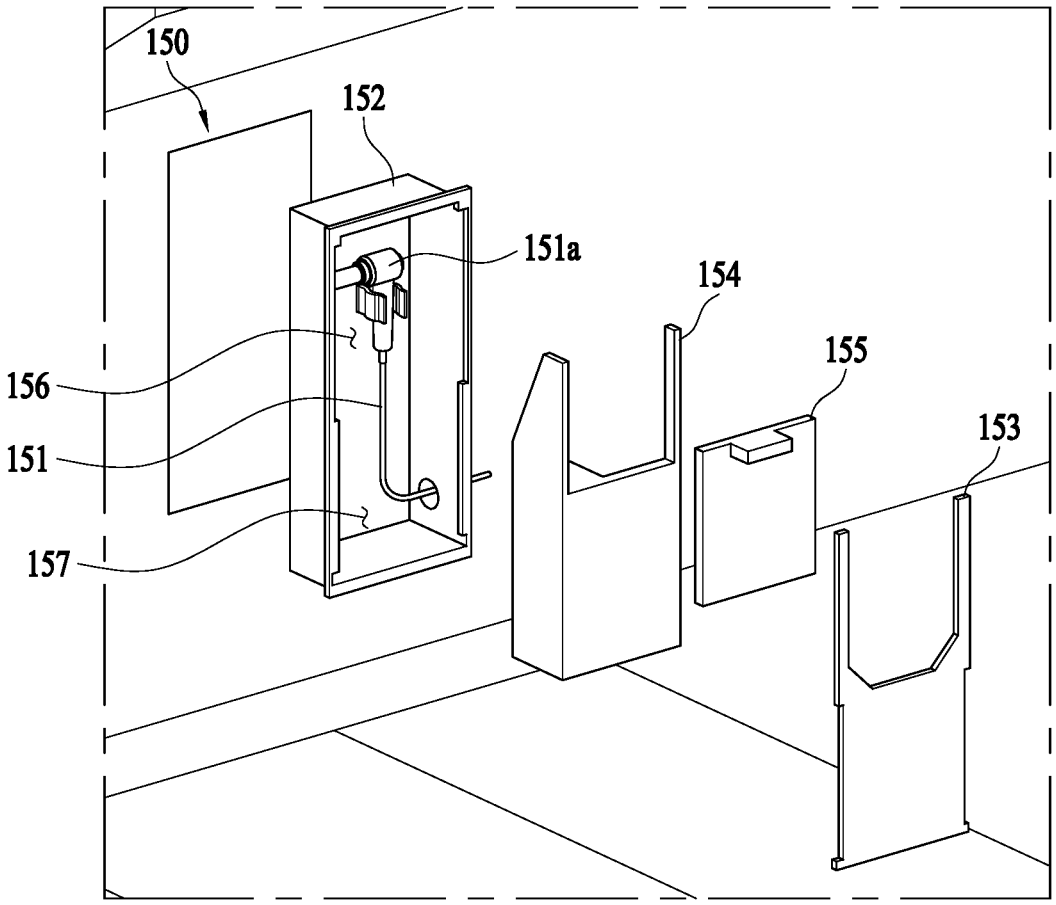
FIG. 10 is an exploded perspective view illustrating an example state of a cable box.

The cable box 150 can include a first area 156 (see FIG. 10) and a second area 157 (see FIG. 10). The first area 156 of the cable box 150 can directly communicate with the refrigerator space 111*a* of the refrigerator 100 and can be opened and closed by a cable box door 155. A power cable terminal 151*a* can be disposed in the first area 156, and when the cable box door 155 is opened, the power cable terminal 151*a* can be exposed to be connected to the independent power supply part 240. In the second area 157, a cable of a power cable 151 can be stored, and the second area 157 may not directly communicate with the refrigerator space 111*a* of the refrigerator 100. In some cases, the power cable 151 can be an automatic reel type and the wound power cable 151 can be built in the second area 157. In some examples, as the power cable terminal 151*a* is withdrawn, the power cable 151 wound in the second area 157 can be drawn out and the length of the power cable 151 exposed to the refrigerator space 111*a* can be adjusted.

Figure 11:
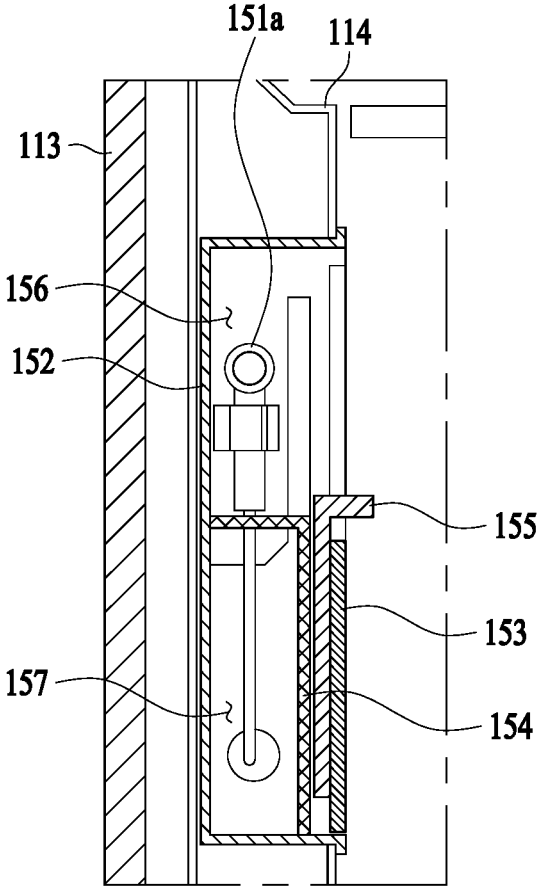
FIG. 11 is a cross-sectional view illustrating an example state of a cable box.

FIG. 10 is an exploded perspective view illustrating an example state of the cable box 150, and FIG. 11 is a cross-sectional view illustrating an examples state of the cable box 150.

The cable box 150 can include a cable outer housing 152, a separation bracket 154, the cable box door 155 and a cable inner housing 153.

In some implementations, the cable outer housing 152 can be define in a rectangular parallelepiped shape with one surface open. In order to help the understanding of the present disclosure, a rectangular parallelepiped shape is described, but the present disclosure is not limited thereto and a structure that can define a space inside may be applied without limitation.

In some cases, the cable outer housing 152 can pass through a portion of the inner case 114 of the main body 110 to be disposed in a space between the outer case 113 and the inner case 114. In some cases, an open surface of the cable outer housing 152 can be aligned with a hole defined in the inner case 114.

The separation bracket 154 can define the first area 156 and the second area 157 of the cable box 150 by the separation bracket 154 being inserted into the cable outer housing 152 to divide the space of the cable outer housing 152. In some cases, the separation bracket 154 closes the second area 157 with respect to the refrigerator space 111*a* to prevent foreign substances from entering from the refrigerator space 111*a*, and thus preventing breakdown or a malfunction of the refrigerator 100.

The cable inner housing 153 can be coupled to the open surface of the cable outer housing 152, but the first area 156 of the cable box 150 can be opened and the second area 157 can be closed. The cable inner housing 153 can be aligned with the surface of the inner case 114 of the main body 110.

In some cases, the cable box door 155 can be disposed between the cable outer housing 152 and the cable inner housing 153, and can reciprocate while sliding in the first area 156 and the second area 157 of the cable box 150. In some examples, when the cable box door 155 is disposed in the first area 156, the cable box 150 can be closed and separated from the refrigerator space 111*a*, and when the cable box door 155 is disposed in the second area 157, the first area 156 of the cable box 150 can communicate with the refrigerator space 111*a*.

In some cases, the power cable 151 of the cable box 150 can be drawn out so that the power cable terminal 151*a* can be electrically connected to the independent power supply part 240 of the independent refrigerator 200 to receive power from the main body power supply part. While the independent power supply part 240 is connected to the main body power supply part, the independent refrigerator 200 can be operated with the power supplied from the main body power supply part, and the independent power supply part 240 (for example, a battery) can be charged.

It will be apparent to those skilled in the art that various modifications and variations can be made in the present disclosure without departing from the spirit or scope of the disclosure.

The above detailed description should not be construed as restrictive in all respects and should be considered as illustrative. The scope of the present disclosure should be determined by reasonable interpretation of the appended claims, and all modifications within the equivalent scope of the present disclosure are included in the scope of the present disclosure.

What is claimed is:

1. A refrigerator comprising:

a main body defining a first cooling space;

a door configured to open and close the first cooling space of the main body;

an independent refrigerator that is detachably disposed in the first cooling space and defines a second cooling space separate from the first cooling space;

a heat pump module disposed in the independent refrigerator and configured to cool the second cooling space of the independent refrigerator;

a main body power supply part that is disposed in the main body and configured to supply power; and an independent power supply part disposed in the independent refrigerator, wherein the independent refrigerator comprises:

an outer housing defining an external shape of the independent refrigerator, an inner housing defining the second cooling space of the independent refrigerator, and a storage compartment configured to be inserted into or withdrawn from the inner housing, wherein the heat pump module is disposed in a space defined between the outer housing and the inner housing, wherein the independent power supply part comprises a battery, wherein the independent power supply part is electrically connected to the main body power supply part through a power cable disposed at a side of the first cooling space of the main body, and wherein the power cable is disposed in a cable box that is disposed in the main body but not to invade the first cooling space, and wherein the cable box is configured to, based on a surface of the cable box being opened toward the first cooling space, be in fluid communication with the first cooling space.

2. The refrigerator of claim 1, wherein the heat pump module comprises a thermoelectric element.

3. The refrigerator of claim 2, wherein the independent power supply part is electrically connected to the main body power supply part to receive power.

4. The refrigerator of claim 1, wherein the cable box comprises:

a first area configured to receive a power cable terminal and, based on the cable box being opened, be in fluid communication with the first cooling space; and a second area configured to receive the power cable and be closed toward the first cooling space.

5. The refrigerator of claim 4, wherein the power cable is an automatic reel type that is disposed in the second area, and configured to, based on a withdrawal of the power cable terminal, be drawn out and change a length exposed to the first cooling space.

6. The refrigerator of claim 5, wherein the power cable is electrically connected to the main body power supply part, and the power cable terminal is coupled to the independent power supply part of the independent refrigerator to electrically connect the main body power supply part and the independent power supply part.

7. The refrigerator of claim 4, wherein the cable box further comprises a cable box door configured to move between the first area and the second area and close or open the first area toward the first cooling space.

8. The refrigerator of claim 1, wherein the first cooling space comprises a refrigerator space and a freezer space.

9. The refrigerator of claim 8, wherein the independent refrigerator is disposed in the refrigerator space.

10. The refrigerator of claim 8, wherein the independent refrigerator is disposed in the freezer space.

11. The refrigerator of claim 1, wherein the storage compartment comprises a swing bar that is disposed in a width direction of the storage compartment and configured to rotate around a virtual axis parallel to the width direction of the storage compartment.

12. The refrigerator of claim 11, wherein the swing bar comprises a beverage holder defining a plurality of semi-circular grooves.

13. The refrigerator of claim 11, wherein the swing bar is disposed at a predetermined distance from a sliding door.

* * * * *